US008225755B2

(12) United States Patent
Martinsson et al.

(10) Patent No.: US 8,225,755 B2
(45) Date of Patent: Jul. 24, 2012

(54) FLEXIBLE INTAKE SYSTEM FOR A TWO-STROKE INTERNAL COMBUSTION ENGINE

(75) Inventors: Pär Martinsson, Jönköping (SE); Stefan Kullberg, Jönköping (SE); Anders Köhler, Landvetter (SE); Anders Reuterberg, Lerum (SE); Niklas Sundberg, Alingsås (SE); Kenth Gustavsson, Jönköping (SE)

(73) Assignee: Husqvarna AB, Huskvarna (SE)

( * ) Notice: Subject to any disclaimer, the term of this patent is extended or adjusted under 35 U.S.C. 154(b) by 896 days.

(21) Appl. No.: 11/570,836

(22) PCT Filed: Jul. 9, 2004

(86) PCT No.: PCT/SE2004/001118

§ 371 (c)(1),
(2), (4) Date: Mar. 14, 2011

(87) PCT Pub. No.: WO2006/006896

PCT Pub. Date: Jan. 19, 2006

(65) Prior Publication Data

US 2011/0174258 A1 Jul. 21, 2011

(51) Int. Cl.
*F02B 25/00* (2006.01)

(52) U.S. Cl. ..... 123/73 R; 123/184.22

(58) Field of Classification Search ..... 123/73 R, 123/73 A, 73 PP, 184.21–184.23, 184.61
See application file for complete search history.

(56) References Cited

FOREIGN PATENT DOCUMENTS

| | | |
|---|---|---|
| DE | 4035016 A1 | 5/1991 |
| DE | 20313567 U1 | 12/2003 |
| DE | 10312096 A1 | 9/2004 |

*Primary Examiner* — Noah Kamen
(74) *Attorney, Agent, or Firm* — Nelson Mullins Riley & Scarborough LLP

(57) ABSTRACT

This invention relates to a flexible intake system for a crankcase scavenged two-stroke internal combustion engine (10) having an additional air supply to its transfer ducts. The intake system comprises a flexible intake duct (22) connecting a fuel supply unit (21) e.g. a carburetor with an engine cylinder (11) and at least one flexible air duct (40) connecting a valve housing (42) for additional air with the engine cylinder. The end portion of the flexible intake duct (22) and at least one air duct (40) is secured to the cylinder by means of a baffle (23) made of a stiffer material than the ducts (22, 40) themselves.

14 Claims, 5 Drawing Sheets

47
46
40
42
41
43
44
45
23
48
49
51
50
19
52
53
35
20
21
22

14
15
12
16
10
13
18
11
17

FLEXIBLE INTAKE SYSTEM FOR A TWO-STROKE INTERNAL COMBUSTION ENGINE

TECHNICAL FIELD

This invention relates to a flexible intake system for a crankcase scavenged two-stroke internal combustion engine having an additional air supply to its transfer ducts, the intake system comprising a flexible intake duct connecting a fuel supply unit e.g. a carburettor with an engine cylinder and further comprising at least one flexible air duct connecting a valve housing for additional air with the engine cylinder.

BACKGROUND OF THE INVENTION

Internal combustion engines of the type mentioned above are intended to be used for driving different kind of hand held tools such as chain saws and power cutters. In order to decrease the vibrations transferred from the engine to the handle portion the engine is usually separated from the handle portion by means of a flexible damping arrangement and to further decrease the vibrations usually certain details of the mass system, such as the carburettor, the air filter system and the fuel tank are usually secured to the handle portion. This also decreases vibrations for the carburettor thereby increasing carburettor reliability. Consequently there is a demand for flexible connections between the different details on the handle portion and the engine but since these connections have to be secured to the engine at a rather concentrated area the assembling procedure becomes complicated. In particular the assembling procedure for securing the different intake ducts for mixture and air to the cylinder of the engine is time consuming and it is also difficult to dismount the arrangement when making maintenance and repairing the hand held tool. Further there is a need for a more stable and reliable fastening arrangement for the different ducts.

SUMMARY OF THE INVENTION

The purpose of this invention is to eliminate or at least reduce the drawbacks mentioned above in order to get a simple arrangement connecting the cylinder of the engine with the different ducts thereby facilitating assembly and dismounting. This is achieved by means of a device having the characteristics mentioned in the claims.

BRIEF DESCRIPTION OF THE DRAWING

The invention will be described in the following with reference to the accompanying drawing figures, which show two preferred embodiments of the invention.

FIG. 5*a* is a front perspective view of a second embodiment of the invention whereas

DETAILED DESCRIPTION OF PREFERRED EMBODIMENTS

Figures 1, 2:
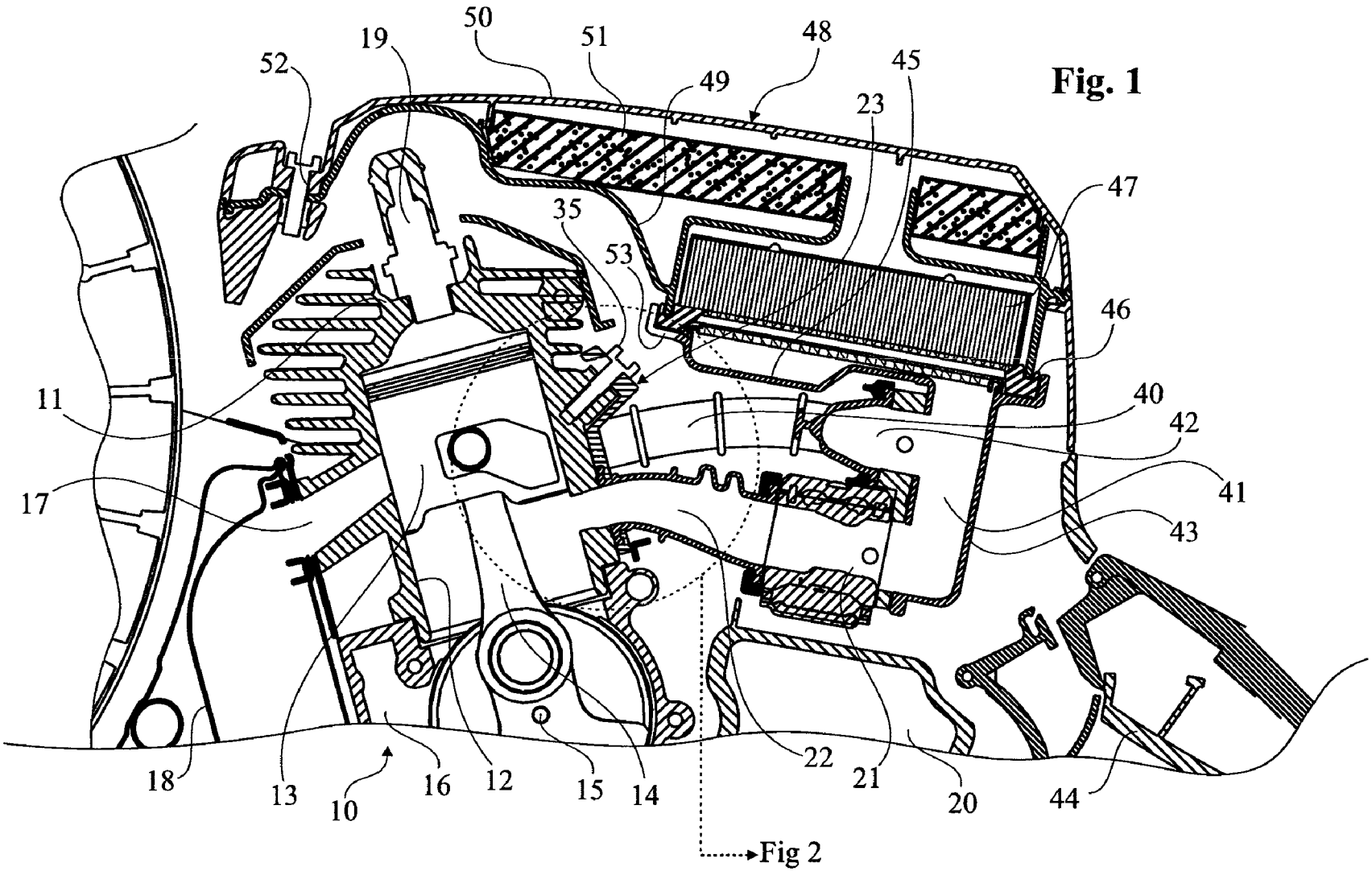
FIG. 1 is a vertical section of a first embodiment of a hand held tool provided with the invention.
FIG. 2 is an enlarged view of a part of FIG. 1.
Figure 2:
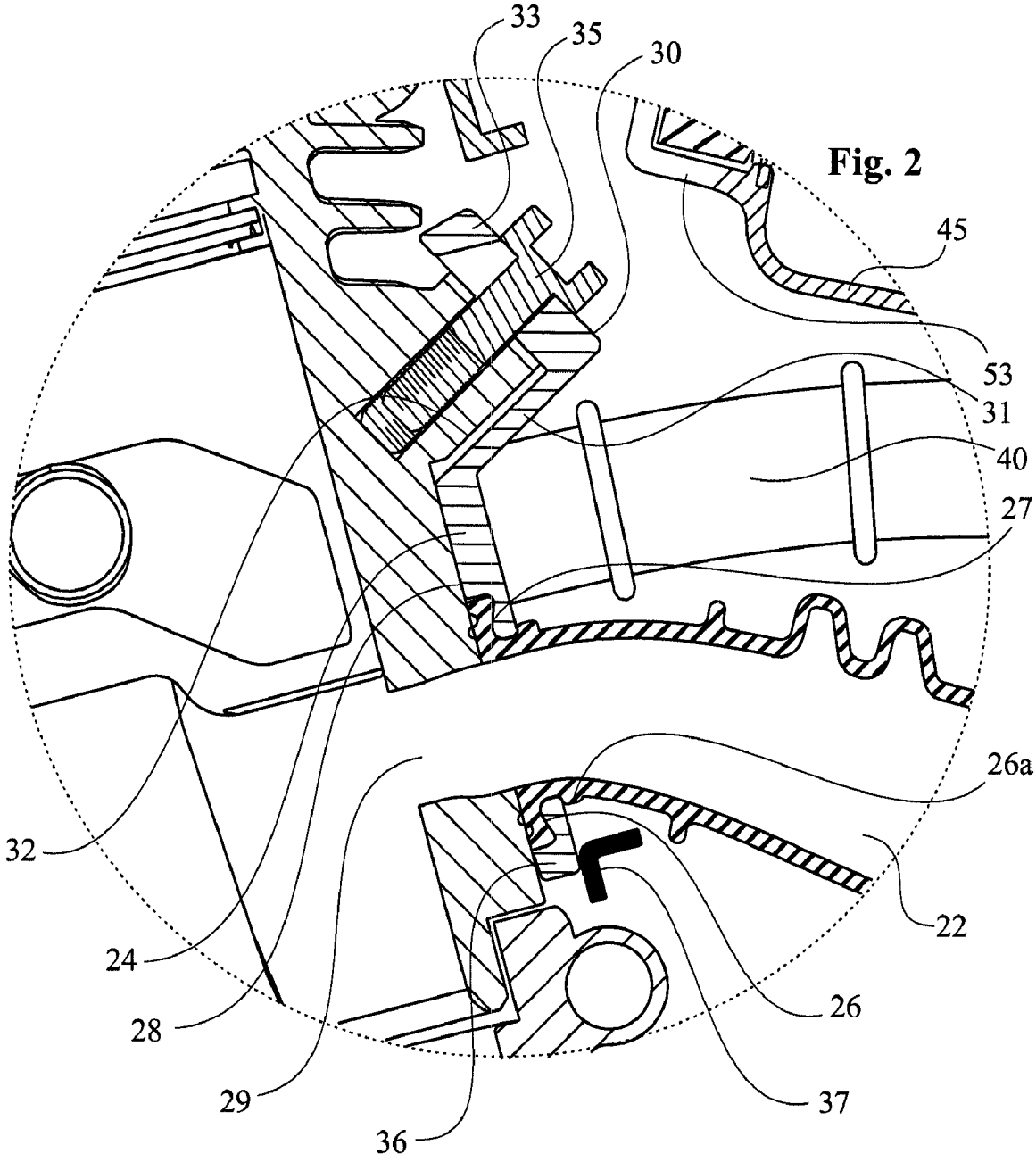
Figure 3:
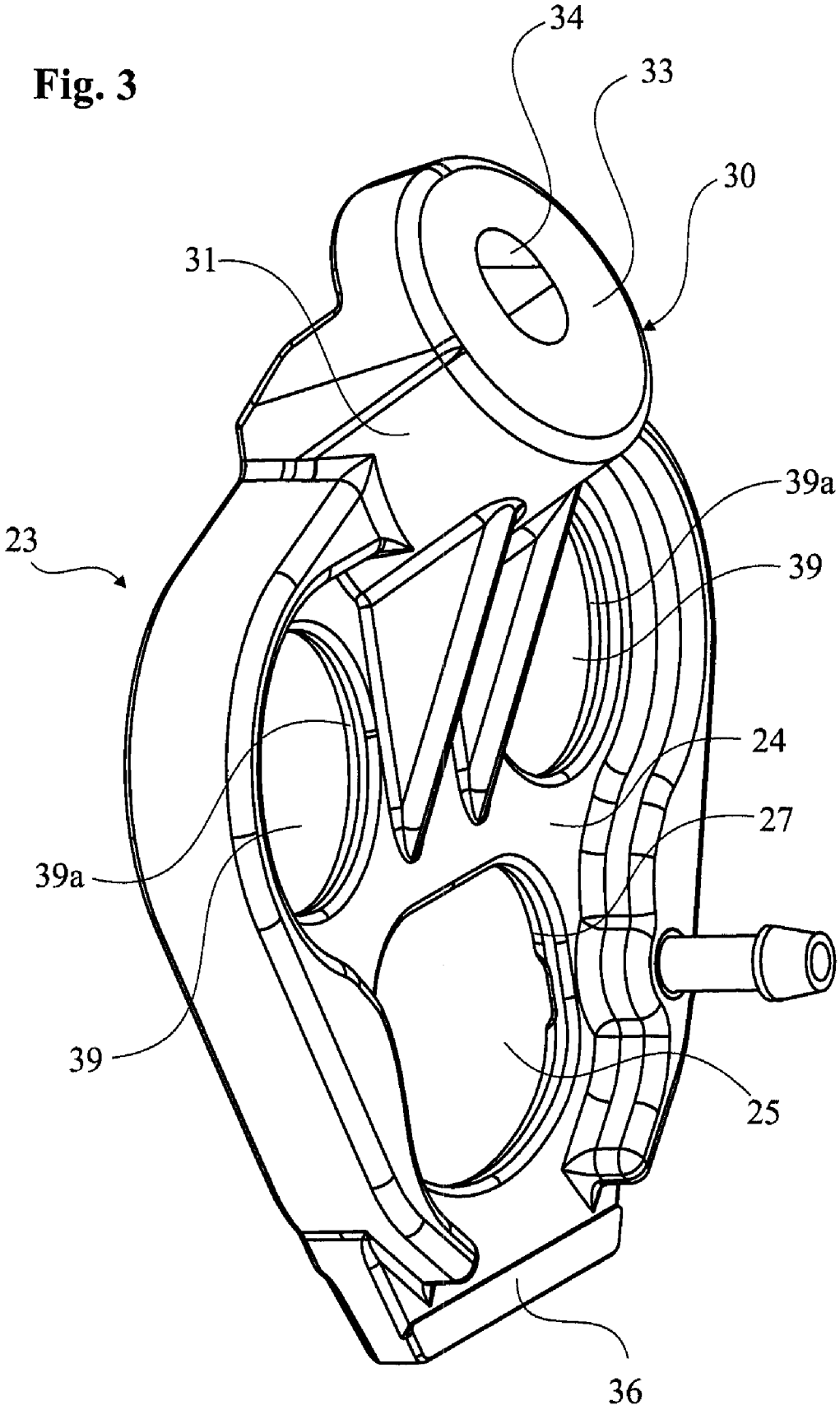
FIG. 3 is a perspective view of a detail of the embodiment in FIG. 1.

The arrangement shown in FIG. 1-3 comprises a two-stroke internal combustion engine 10 having a cylinder 11 with a cylinder bore 12 in which a piston 13 is movable. The piston 13 is via a piston rod 14 connected to a crankshaft 15 rotating in a crankcase 16. The cylinder is in a conventional way provided with an exhaust outlet 17, connected to a muffler 18, and with a spark plug 19. Further there is a fuel tank 20 to which a carburettor 21 is connected.

The carburettor 21 is via an air/fuel duct 22 connected to a baffle 23 that is secured to the cylinder 11. The air/fuel duct 22 is made of a flexible material such as rubber or plastic whereas the baffle is manufactured of a stiffer material such metal or a heat resisting plastic. The baffle 23 comprises a plate shaped lower part 24 provided with one opening 25 in which one end of the air/fuel duct 22, that is provided with an end flange 26, is inserted. The end flange 26 rests in a recess 27 arranged around the edge of the opening 25 at the side of the baffle 23 that faces the cylinder 11 and serves as a sealing against a flat seat portion 28 arranged at the cylinder 11 around an inlet opening 29 for the air/fuel supply. Preferably the shape of the recess 27 is such that it is more narrow close to the edge of the opening than it is at a distance from the opening thereby safeguarding that the end flange 26 does not fall out of the recess 27. There also is an additional flange 26*a* arranged at a distance from the end flange 26 and safeguarding that the baffle 23 is clamped at the outer end of the air/fuel duct 22 between the flanges.

Figure 4:
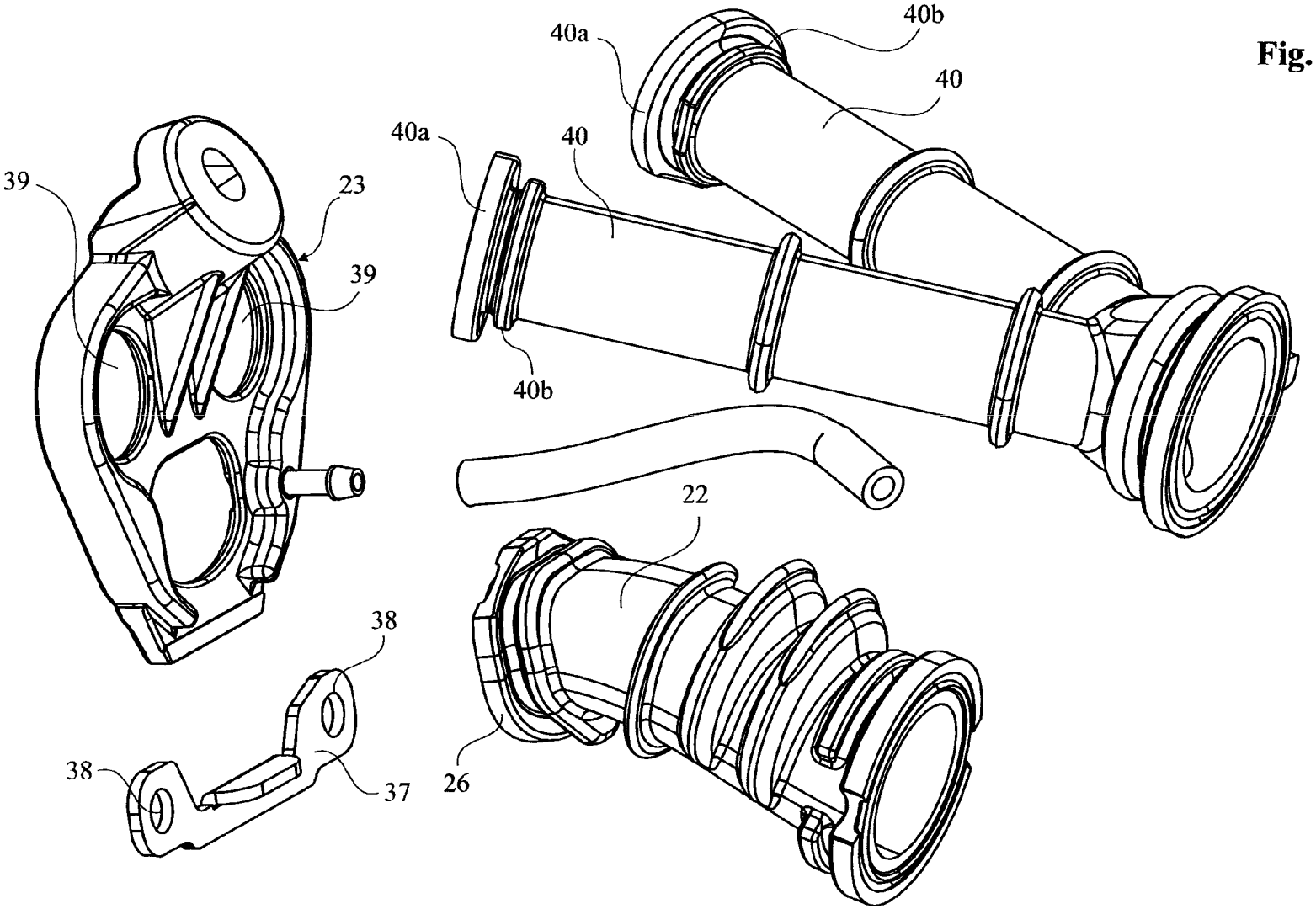
FIG. 4 is an exploded view of some details according to the arrangement in FIG. 1-3.

The upper portion of the baffle 23 is provided with an L-shaped part 30 (as seen in a vertical section) having a first leg 31 (see FIG. 2-3) that is mainly parallel to an outer surface 32 of the cylinder 11, said surface being inclined about 45° with respect to the flat seat portion 28, and a second leg 33 that is provided with an opening 34 through which a screw 35 is inserted and fixed to the cylinder. The lower portion of the baffle 23 is provided with an end portion 36 that is clamped between a yoke member 37 (see FIG. 4) fixed to the cylinder by means of screws inserted through openings 38 arranged in the yoke member and secured to the outside of the cylinder wall.

The plate shaped lower part 24 of the baffle 23 is provided with two additional openings 39 that in the similar way as the lower opening 25 each are connected to an air duct 40 of flexible material. The openings 39 are aligned with air transfer ducts inlets (not shown in FIG. 1-4) arranged at the flat seat portion 28 close to the inlet 29 for the air/fuel supply. One end of each air duct 40 is connected to an air inlet 41 via a valve arrangement 42 in order to supply additional air to the transfer ducts whereas the other end of the air duct 40 is provided with an end flange 40*a* inserted in a corresponding recess 39*a* arranged around the openings 39 of the baffle 23. Each air duct is also provided with an additional flange 40*b* operating in the similar way as the additional flange 26*a* described above. Also the air inlet side of the carburettor 21 is connected to said air inlet 41. There is an impulse nozzle 62 pressed into the baffle. An impulse hose 61 is attached to it.

The air inlet 41 constitutes an internal channel within a bracket 43 that is secured to handle part 44 of the hand held tool together with the fuel tank 20. The handle part 44 is separated from the engine 10 and the tool driven by the engine by means of a flexible support arrangement (not shown) that dampens the vibrations from the engine to the handle.

The upper part of the bracket 43 constitutes a main filter bottom 45 supporting a sealing 46 on which a main filter 47 is placed. The main filter 47 is clamped between the sealing 46 and a filter cover 48 comprising a lower and an upper cover part 49, 50 enclosing a prefilter 51 for the flow of air from the atmosphere to the air inlet 41. The filter cover 48 is secured to the handle part 44 by means of one or several screws 52. The main filter bottom 45 is also provided with an opening 53 placed in line with the axial direction of the screw 35 such that the screw can be removed in order to remove the baffle 23. This opening is normally covered by the sealing 46. The screw 35 is inclined downwards, i.e. its lower end is pointing somewhat towards the crankcase 16, and preferably more than 20° and less than 40°.

The arrangement mentioned above is assembled in the following manner. In a pre-mounting stage the air/fuel duct 22 as well as the air ducts 40 are inserted into the openings 25 and 39 of the baffle 23 such that the end flanges 26, 40*a* are taken up by the recesses 27, 39*a*, whereas the flanges 26*a* serve as clamping means for the baffle 23. Then the carburettor 21, the valve arrangement 42 and the bracket 43 with the main filter bottom 45 are secured to the different ducts such that the complete arrangement can be treated as one unit. This unit is then fastened to the cylinder by pushing the end portion 36 of the baffle 23 in between the yoke member 37 and the cylinder wall such that the end flanges 26, 40*a* create a sealing between the baffle 23 and the seat portion 28. Simultaneously the second leg 33 of the L-shaped part 30 will come into engagement with the corresponding surface of the cylinder such that the screw 35 can be inserted through the opening 53 of the main filter bottom 45 and be fixed to the cylinder 11. Then the sealing 46 and the main filter 47 is placed on the main filter bottom 45 and finally the filter cover 48 with the pre-filter 51 is placed on top of the main filter and is secured to the handle portion by means of the screw 52 and additional screws if necessary.

Figure 5A:
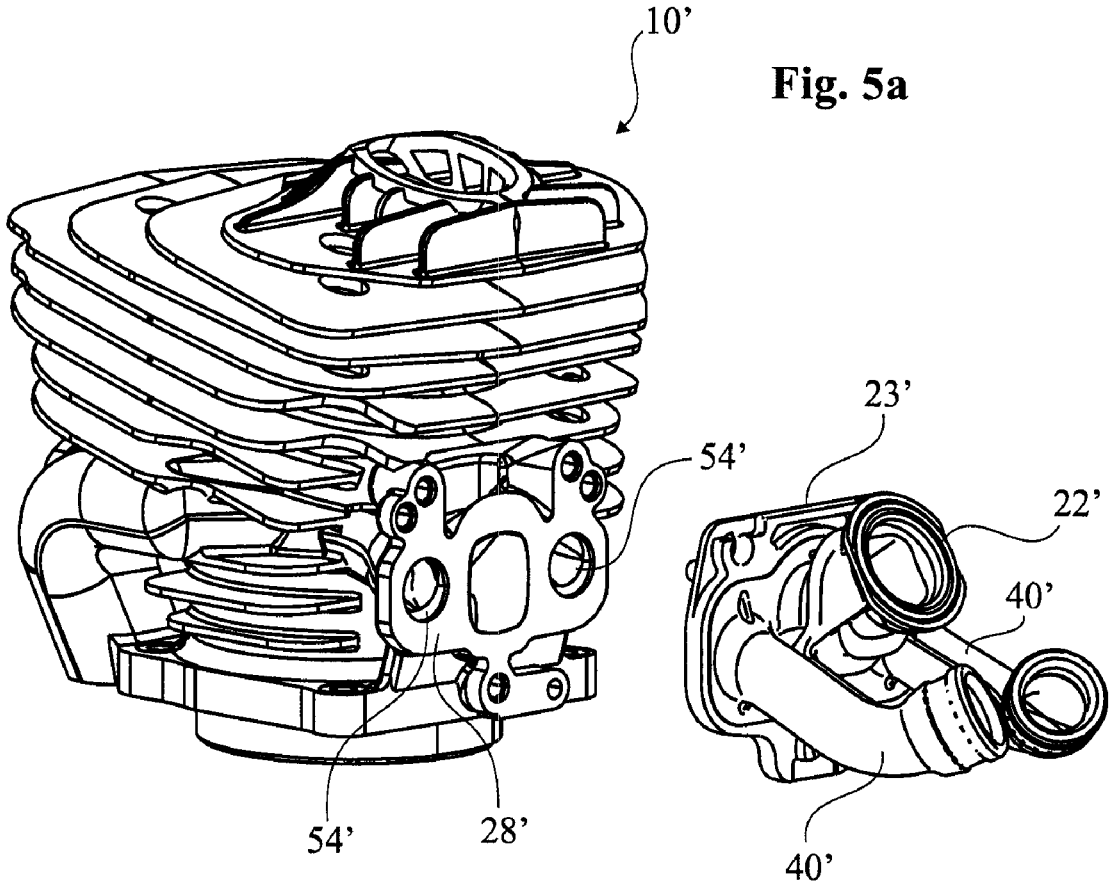
Figure 5B:
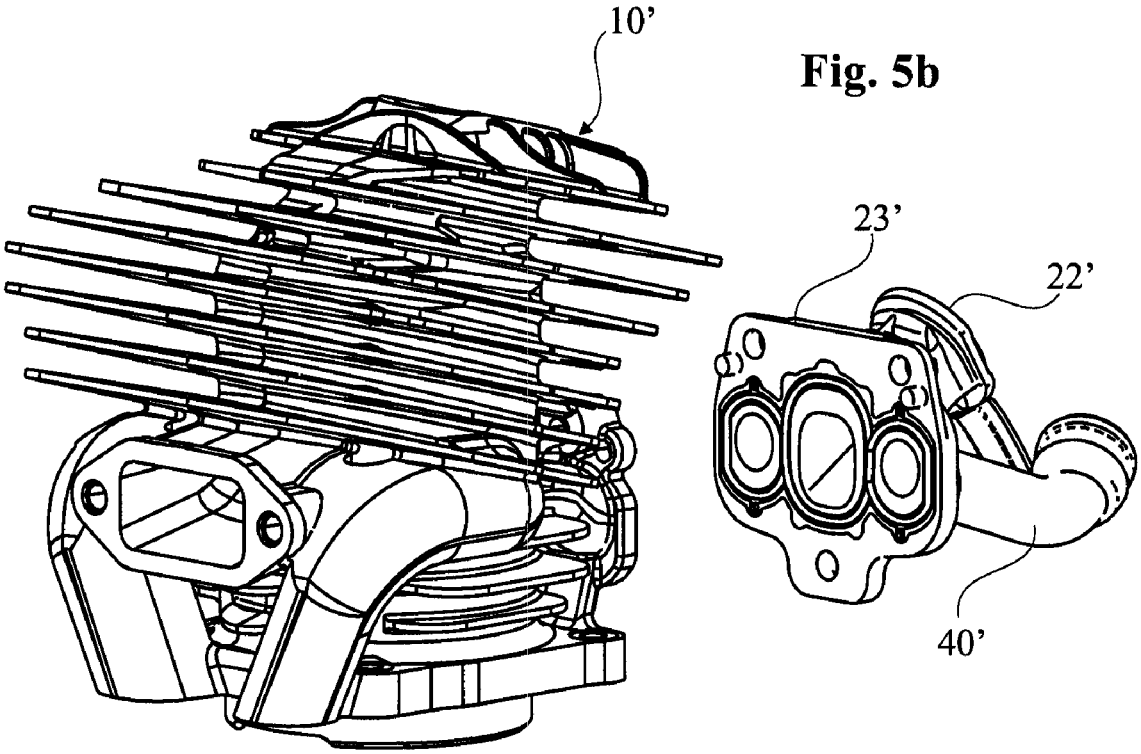
FIG. 5*b* is a rear perspective view of said second embodiment.

The second embodiment of the invention according to FIGS. 5*a* and 5*b* differs from the first embodiment in that the air/fuel duct 22' as well as the air ducts 40' are secured to the baffle 23' by means of molding or vulcanizing methods or by means of chemical bindings. Also in this embodiment the ducts are arranged through the openings in the baffle 23' such that the ends create a sealing at the side facing the seat 28' of the cylinder of the engine 10'. FIG. 5*a* also shows the inlet ports 54' of the air ducts 40'. A number of sealing ridges 55', 56', 57' are formed in the flexible material facing the seat 28 of the cylinder 11'. Each ridge encloses an inlet port 54', 61' provided in the seat 28'. Each ridge is surrounded by a ditch 58', 59', 60'. For this embodiment there is a ditch on both sides of each ridge. This is useful when the ridge is pressed against seat 28'.

For the other embodiment as seen in FIG. 2 sealing ridge 56 is enclosed by an outer ditch 59. This figure is schematic as ridge 56 will be compressed and not seat 28.

The invention claimed is:

1. A flexible intake system for a crankcase scavenged two-stroke internal combustion engine having an additional air supply to its transfer ducts, the intake system comprising a flexible intake duct connecting a fuel supply unit with an engine cylinder and further comprising at least one flexible air duct connecting a housing for additional air with the engine cylinder, and an end portion of the flexible intake duct and of the at least one air duct is secured to the cylinder via a baffle made of a stiffer material than the ducts themselves, wherein the baffle is provided with a first end portion arranged to be inserted between a holder means and the cylinder wall.

2. System according to claim 1, wherein the baffle is provided with a second end portion arranged at the opposite side of the baffle with respect to the first end portion, said second end portion being provided with a securing means.

3. System according to claim 2, wherein the securing means comprises at least one fastener, the at least one fastener being inclined downwards with respect to an axes perpendicular towards a flat seat for the baffle arranged on the cylinder wall.

4. System according to claim 3, wherein the at least one fastener is inclined more than 15° downwards but less than 60° downwards compared to an axis perpendicular towards the flat seat.

5. System according to any one of the previous claims, wherein the baffle is provided with a flat portion that rests against a seat arranged at the cylinder wall and being provided with inlet openings for the air/fuel and for the additional air.

6. System according to claim 1, wherein at least one of said ducts comprise an end flange that is inserted through an opening in the baffle and that serves as a sealing against the cylinder wall.

7. System according to claim 6, wherein the edge of said opening is provided with a recess facing the cylinder and in which the end flange is placed.

8. System according to claim 7, wherein said recess has a shape that it is more narrow close to the edge of the opening than it is at a distance from the opening.

9. System according to claim 1, wherein at least one of the ducts is secured to the baffle by means of vulcanization or by molding or chemical binding methods.

10. System according to claim 9, wherein at least one of the ducts is secured to the baffle via a molding method used for the ducts, molding through a number of apertures in the baffle.

11. System according to claim 1, wherein a number of sealing ridges are formed in the flexible material facing a seat of the engine cylinder.

12. System according to claim 1, wherein at least one of said ducts is made of rubber or plastic.

13. System according to claim 1, wherein said baffle is made of a heat resistant plastic or a metal.

14. System according to claim 1, wherein the holder means is fixed in proximity to the cylinder wall prior to insertion of the first end portion between the holder means and the cylinder wall.

* * * * *